US007198074B2

(12) United States Patent
Lemme et al.

(10) Patent No.: US 7,198,074 B2
(45) Date of Patent: Apr. 3, 2007

(54) MOTORIZED VACUUM/PRESSURE PUMP AND STOPPER

(75) Inventors: Anthony R. Lemme, Wallingford, CT (US); Chester M Fudge, Durham, CT (US)

(73) Assignee: Epicurean International Corporation, Wallingford, CT (US)

( * ) Notice: Subject to any disclaimer, the term of this patent is extended or adjusted under 35 U.S.C. 154(b) by 452 days.

(21) Appl. No.: 10/605,468

(22) Filed: Oct. 1, 2003

(65) Prior Publication Data

US 2005/0074342 A1 Apr. 7, 2005

(51) Int. Cl.
*B65B 3/16* (2006.01)

(52) U.S. Cl. ..... 141/114; 141/65; 141/67; 141/192

(58) Field of Classification Search ..... 141/1, 141/4, 7, 10, 38, 65, 67, 94, 95, 114, 192, 141/198, 302; 417/120, 144
See application file for complete search history.

(56) References Cited

U.S. PATENT DOCUMENTS 4,763,803 A 8/1988 Schneider
4,911,314 A 3/1990 Schneider
4,998,633 A 3/1991 Schneider
5,031,785 A 7/1991 Lemme
5,699,940 A 12/1997 Clark, II
5,778,763 A 7/1998 Ford, Sr.
5,806,575 A 9/1998 Tsay
6,155,313 A 12/2000 Smalley
6,250,343 B1 6/2001 Chen
6,257,285 B1 7/2001 Robinson et al.
6,520,071 B1 2/2003 Lanza
2002/0011276 A1 1/2002 Sander

*Primary Examiner*—Timothy L. Maust
(74) *Attorney, Agent, or Firm*—DeLio & Peterson, LLC; Peter W. Peterson

(57) ABSTRACT

A pump and stopper combination for vacuum or pressure sealing a container. The stopper has a pour opening and a one-way valve movable between an operative position to permit one-way flow of fluid into or out of the container when the pour opening is in the closed position, and an inoperative position when the pour opening is in the open position. A vacuum/pressure pump that connects to the stopper includes a drive adapted to convert rotational movement of a motor to reciprocating motion of a pump piston in a chamber, and one-way pump valves mounted in a selectable flow control member. The selectable flow control member is movable between pressure and vacuum positions to permit passage of fluid only into or out of the pump chamber. The pump also includes an indicator for indicating when a desired level of vacuum or pressure has been reached. The pump may be incorporated into a container lid.

33 Claims, 10 Drawing Sheets

MOTORIZED VACUUM/PRESSURE PUMP AND STOPPER

BACKGROUND OF INVENTION

1. Field of the Invention

This invention relates to motorized pumps and stoppers which may be used for pressurizing and/or evacuating food or drink containers and, in particular, to a motorized vacuum/pressure pump which employs a piston drive mechanism to convert rotary motion of a motor to a reciprocating motion of a piston and a valve selectable to change the pump between vacuum and pressure pumping modes, and a stopper which may be switched between pour and vacuum/pressure seal positions. The pump may be incorporated into a container lid.

2. Description of Related Art

A combination vacuum/pressure pump for preserving wine and/or foods under vacuum, and pressurizing carbonated drinks and other foods, is disclosed in U.S. Pat. No. 5,031,785. This pump utilizes a hand-pumping mechanism, switchable between vacuum and pressure modes, and mates with a valve stopper, likewise switchable between vacuum and pressure modes, that is disposed in the open mouth of a food or drink container. While this combination vacuum/pressure pump is quite useful, it requires the user to open the pump head to switch between the vacuum and pressure pumping modes. A more convenient vacuum/pressure switching method would be useful. Also, it would be useful to have a vacuum/pressure pump which does not require hand-pumping operation.

The '785 patent also discloses a stopper for use with the vacuum/pressure pump, which has a valve element that may be reversed between vacuum and pressure sealing positions. However, in order to access the contents of the food or drink container, the stopper must be removed from the mouth of the container. It would be useful to provide a way to access the contents of the container without having to remove the stopper.

Another vacuum pump and stopper system employs an audible click when the system reaches a desired level of vacuum, relying on a mechanical system to generate the sound. It would be useful to have an indicator in both a vacuum and pressure system that provides a reliable indicator, not limited to a sound, to indicate when the desired level of vacuum or pressure has been achieved.

Some foods or drinks that are preferably stored at a vacuum also are provided in containers that cannot be closed with bottle stoppers, such as coffee in conventional one-pound containers. It would be desirable to have a way to automatically seal and store the contents of such containers in a vacuum.

Moreover, it is important in vacuum/pressure pump and stopper systems to utilize one-way valves that are inexpensive to manufacture, yet seal properly.

SUMMARY OF INVENTION

Bearing in mind the problems and deficiencies of the prior art, it is therefore an object of the present invention to provide a combination vacuum/pressure pump, which is conveniently switchable between the vacuum and pressure modes.

It is another object of the present invention to provide a vacuum/pressure pump which is externally switchable between vacuum and pressure modes.

A further object of the invention is to provide a combination vacuum/pressure pump which does not require hand pumping operation.

It is yet another object of the present invention to provide a combination vacuum/pressure pump which is of compact design and which may easily fit into, and be operated by, a user's hand.

It is a further object of the present invention to provide a stopper for vacuum or pressure sealing a food or drink container that provides ready access to the contents of the container, without having to remove the stopper.

It is another object of the present invention to provide a pump that reliably indicates the desired level of vacuum or pressure.

A further object of the present invention is to provide a pump and lid combination which automatically seals and store the contents of such containers in a vacuum.

Yet another object of the present invention is to provide a one-way valve that may be used in both vacuum/pressure pumps and stoppers that is inexpensive to manufacture, yet seals properly.

The above and other objects, which will be apparent to those skilled in art, are achieved in the present invention which is directed in one aspect to a combination vacuum and pressure pump comprising a pump housing having an opening for connection to a container to be evacuated or pressurized, a pump chamber within the pump housing, and a piston in sliding, substantially airtight engagement with walls of the pump chamber, adapted to reciprocate between pressure and vacuum strokes within the chamber. The pump includes at least one one-way valve communicating with the pump chamber, permitting passage of fluid only into or out of the pump chamber and a selectable flow control member in the pump housing having a pair of passages therein and movable between pressure and vacuum positions. In the pressure position, one of the selectable flow control member passages connects the pump chamber and the pump housing opening to permit passage of fluid from the pump chamber out of the housing connection opening during the piston pressure stroke, and the other of the selectable flow control member passages permits passage of fluid into the pump chamber from a region external to the pump chamber through a one-way valve during the piston vacuum stroke. In the vacuum position, one of the first selectable flow control member passages connects a one-way valve to the pump chamber to permit passage of fluid from the pump chamber out to the external region through the one-way valve during the piston pressure stroke, and the other of the selectable flow control member passages permits passage of fluid from the housing connection opening to the pump chamber during the piston vacuum stroke.

The pump preferably includes a motor for reciprocating the piston within the pump chamber, more preferably a motor having a rotating output shaft and a piston drive for converting rotary movement of the output shaft to reciprocating motion of the piston within the pump chamber.

Preferably, the selectable flow control member has a first passage extending from one side to the other, and the one-way valve is disposed in the selectable flow control member first passage. The selectable flow control member is rotatable: i) in the pressure position, to place the one-way valve in an orientation to permit passage of fluid only into the piston chamber, and ii) in the vacuum position, to place the one-way valve in an orientation to permit passage of fluid only out of the piston chamber.

The selectable flow control member may comprise a cylindrical body rotatingly received within a cavity in the pump housing, wherein the passage therein extends from an opening on one side surface of the body to an opening on the other side surface of the body. There is further included a seal extending around the flow control member body, such as O-rings, between the body and the cavity, separating the passage openings on each side surface of the flow control member body. The selectable flow control member preferably also includes a handle extending outward of the pump housing for rotating the selectable flow control member between the pressure and vacuum positions.

More preferably, the selectable flow control member has a pair of passages extending from one side to the other, and includes a first one-way valve disposed in one of the selectable flow control member passages and a second one-way valve disposed in the other of the selectable flow control member passages, with the one way valves being disposed in opposite orientations in the passages. The selectable flow control member is rotatable: i) in the pressure position, to place the first one-way valve in an orientation to permit passage of fluid from the external region only into the piston chamber and to place the second one-way valve in an orientation to permit passage of fluid only out from the piston chamber and through the housing connection opening, and ii) in the vacuum position, to place the first one-way valve in an orientation to permit passage of fluid from the piston chamber only out to the external region and to place the second one-way valve in an orientation to permit passage of fluid only into the piston chamber from the housing connection opening.

In another embodiment, the pump includes a pair of one-way valves communicating with the pump chamber, with the first one-way chamber valve permitting passage of fluid only into the pump chamber, and the second one-way chamber valve permitting passage of fluid only out of the pump chamber. The pump also includes a pair of one-way valves communicating externally to the pump housing, with the first one-way external valve permitting passage of fluid only out to a region external to the pump housing, and the second one-way external valve permitting passage of fluid only out of the housing connection opening. In this embodiment, the selectable flow control member is disposed in the pump housing between the one-way chamber valves and the one-way external valves, and has a pair of passages therein and movable between pressure and vacuum positions. In the pressure position, the first selectable flow control member passage connects the second one-way chamber valve to the housing connection opening and the second selectable flow control member passage connects the pump chamber to the second one-way external valve, thereby permitting passage of fluid from the pump chamber out of the housing connection opening during the piston pressure stroke, and permitting passage of fluid from the external region to the pump chamber during the piston vacuum stroke. In the vacuum position, the first selectable flow control member passage connects the pump chamber to the first external valve opening and the second selectable flow control member passage connects the first chamber valve to the housing connection opening, thereby permitting passage of fluid from the pump chamber out to the external region during the piston pressure stroke, and permitting passage of fluid from the housing connection opening to the pump chamber during the piston vacuum stroke.

The piston drive may comprise a member extending transversely to the direction of movement of the piston and a track extending circumferentially around and engaging the transversely extending member in sliding relationship. The track has a non-linear configuration, preferably substantially sinusoidal, such that, upon rotation of the output shaft, the transversely extending member slides with respect to the track and imparts a reciprocating motion to the operatively connected piston within the pump chamber. Preferably, the transversely extending member is disposed on a rotatable drive member operatively connected to the motor output shaft and comprises at least one wheel slidingly captured in the track, which extends circumferentially around an interior wall of a reciprocating drive member connected to the piston. The rotatable drive member extends within the reciprocating drive member and adapted to rotate the transversely extending member to cause the transversely extending member to slide within the track and impart reciprocating motion to the operatively connected piston within the pump chamber.

In another aspect, the present invention is directed to a pump comprising a pump housing having a pump chamber, and a piston in sliding, substantially airtight engagement with walls of the pump chamber, adapted to reciprocate in a direction between pressure and vacuum strokes within the chamber, for pumping air into or out of the pump. The pump includes a motor in the pump housing powering a rotatable output shaft and a piston drive operatively connecting the motor output shaft and the piston. The piston drive comprises a member extending transversely to the direction of movement of the piston and a track extending circumferentially around and engaging the transversely extending member in sliding relationship. The track has a non-linear configuration such that, upon rotation of the output shaft, the transversely extending member slides with respect to the track and imparts a reciprocating motion to the operatively connected piston within the pump chamber.

Preferably, the one-way valve comprises a valve seat having an opening therein; and a valve diaphragm having a sealing member supported by flexible arms in a normally biased position against and sealing the valve seat opening. When a fluid such as air is forced in a first direction through the valve seat opening against the sealing member, the arms flex and move the sealing member away from the valve seat opening to permit fluid (air) flow out of the valve seat opening. When the fluid (air) is forced in a direction opposite the first direction, the arms do not flex and the sealing member remains in the normally biased position against and sealing the valve seat opening to restrict fluid flow. More preferably, the sealing member comprises a bulb or cap suspended by a plurality of radially extending arms attached to the valve seat outward of the valve seat opening.

In yet another aspect, the present invention is directed to a pump comprising a pump chamber, a piston in the pump chamber, and the aforedescribed one-way valve communicating with the pump chamber.

A further aspect of the present invention is directed to a pump comprising a housing, a pump chamber in the housing, a piston slidable in the pump chamber, and an indicator for indicating when a desired level of vacuum or pressure has been reached. The indicator comprises a flexible membrane exposed to atmospheric pressure outside the pump and to fluid pressure present within the pump chamber, and a movable electrical contact operatively connected to the membrane. The movable contact completes one circuit when the pressure in the pump falls to a desired pressure below atmospheric pressure, and completes another circuit when the pressure in the pump rises to a desired pressure above atmospheric pressure., The indicator also includes an indicator signal energizable when the movable electrical contact completes either one or the other circuit.

The pump housing opening may be removably connected to an opening of a food or drink container, preferably to a one-way stopper in an opening of a food or drink container.

In another aspect, the present invention is directed to a stopper for contacting and sealing with an opening in a container, the stopper having an opening therethrough between the container interior and exterior and the afore-described one-way valve disposed in the opening.

In a further aspect, the present invention is directed to a stopper for contacting and sealing with an opening in a container, with the stopper having a pour opening for accessing contents in the container. The pour opening is movable between open and closed positions, and includes a one-way valve movably disposed in the stopper between an operative position to permit one-way flow of fluid into or out of the container when the pour opening is in the closed position, and an inoperative position when the pour opening is in the open position.

Preferably, the one-way valve is movable to a first operative position when the pour opening is in the closed position to permit one-way flow of fluid into the container, and to a second operative position when the pour opening is in the closed position to permit one-way flow of fluid out of the container. The stopper more preferably includes a rotatable ball valve body having the pour opening disposed therein in a first direction, and the one-way valve disposed therein in a second direction. The ball valve body is movable between the first and second directions to open and close the pour opening, and respectively render inoperative and operative the one-way valve.

Additionally, the stopper opening between the container interior and exterior includes a central pour opening for pouring out the contents of the container when the container is tipped from an upright position, and at least one parallel passageway adjacent the central pour opening to permit air to flow into the container to release back pressure.

Preferably, the present invention provides the afore-described pump and stopper in combination with each other.

Another aspect of the present invention provides a lid for a container to be maintained at a predetermined vacuum or pressure condition. Attached to a lid portion adapted to seal to the opening of a container are a vacuum or pressure pump having passages for removing or adding fluid through the lid portion, a motor attached to the lid for operating the pump, and a battery attached to the lid for energizing the motor. An electrical circuit connecting the battery and motor includes a normally-closed indicator contact which is opened by an indicator when pressure in the container reaches a predetermined level above or below that outside the container. The circuit also includes a normally-open switch contact closed by a switch when the lid is attached and sealed to a container. When the lid is initially attached and sealed to the container, the indicator and switch contacts are closed and the pump removes or adds fluid to the container through the lid until pressure in the container reaches a predetermined level, whereupon the indicator contact opens. When the lid is removed from the container the switch contact opens and the pump is inoperable. The pump may be the combination vacuum pressure pump, or the vacuum-only or pressure only pump embodiments described above.

BRIEF DESCRIPTION OF DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION

The present invention is directed in various preferred aspects to a hand-held, battery or otherwise powered motorized combination vacuum/pressure pump for either evacuating air from, or pressurizing, liquid containers. In the vacuum mode, it is most useful for removing air from partially filled wine bottles and food containers, to preserve the contents. In the pressure mode, it may be used to add air to pressurize partially filled champagne or soda bottles to preserve their contents and to remove the corks from wine bottles. The motorized combination vacuum/pressure pump is intended to be used in place of the hand-operated vacuum/pressure of your U.S. Pat. No. 5,031,785, and is directly compatible with the one-way vacuum/pressure stopper shown in that patent. Other style stoppers may also be used to vacuum seal or pressurize containers.

In describing the preferred embodiment of the present invention, reference will be made herein to FIGS. 1–21 of the drawings in which like numerals refer to like features of the invention.

Figure 1:
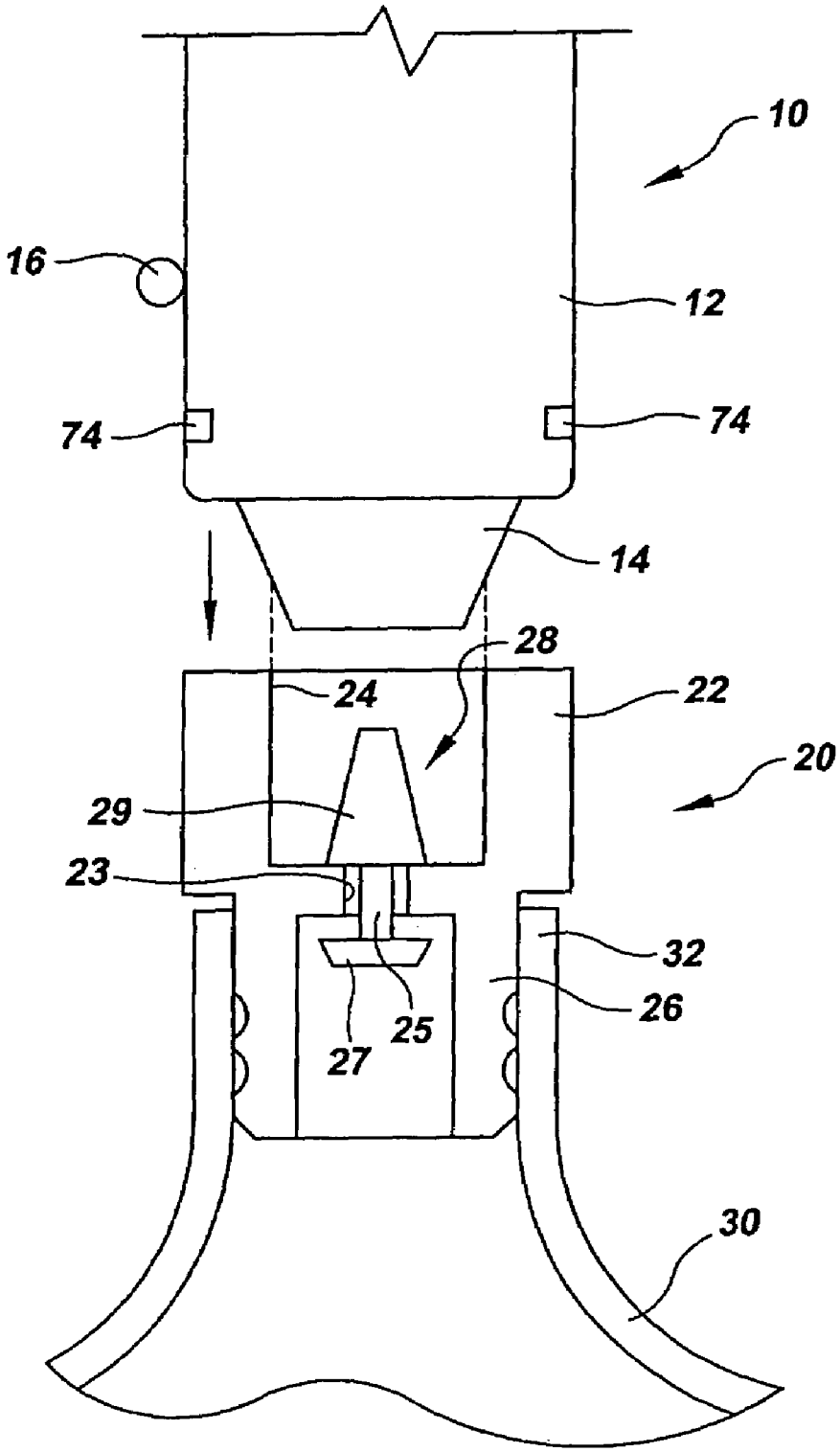
FIG. 1 is a side elevational view, partially in cross section, showing the preferred vacuum/pressure pump of the present invention mating with a prior art stopper in the neck of a food or drink container.
Figure 2:
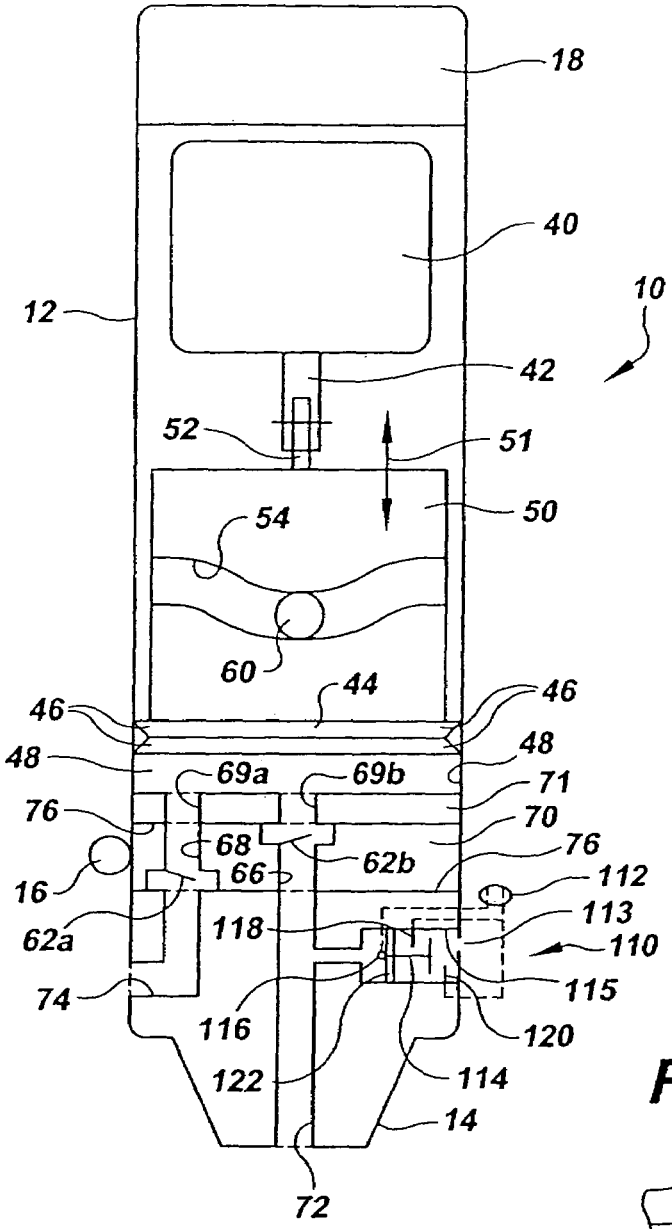
FIG. 2 is a cross-sectional elevational view of the major components of the preferred vacuum/pressure pump of the present invention, showing the vacuum/pressure switch in the vacuum position.

In FIGS. 1 and 2, there is shown the preferred embodiment of the combination vacuum/pressure pump of the present invention 10. Pump housing 12 has at a lower end thereof a pump head 14 which mates with a food, drink or other container 30 which is to be either evacuated or pressurized. As shown in FIG. 1, pump head 14 is in position to mate with a vacuum or pressure stopper 20 of the type depicted in U.S. Pat. No. 5,031,785, the disclosure of which is hereby incorporated by reference. Stopper 20 has a lower cylindrical portion 26 frictionally inserted into the neck opening 32 of container 30. An upstanding collar 22 has an inside corner or lip 24 which mates with the exterior conical surface of pump head 14 as shown by the dotted lines, when the pump head is lowered in the direction of the arrow to mate with stopper 20. Stopper 20 may have a vacuum or pressure configuration, as the contents of container 30 require. As shown in FIG. 1, the stopper 20 is of a vacuum configuration, wherein a mushroom valve 28 has a vacuum sealing head portion 29, which is connected by a valve stopper to a valve stopper button 27. As a vacuum is created by the mated pump, mushroom valve head 29 lifts up and permits air (or other fluid) within container 30 to be evacuated through stopper opening 23. When the vacuum pumping is ended, mushroom valve head 29 returns to seal opening 23. In the reverse, pressure position, mushroom valve 28 serves to prevent the loss of pressurizing fluid within container 30 while permitting the entry of pressurizing fluid through opening 23. Other vacuum or pressure stoppers may be utilized to mate with pump 10. While the operation of the pump of the present invention will be described with reference to pumping air, it is to be understood that the pump may be utilized to pump any other fluid as well, either gaseous or liquid.

As shown in more detail in FIG. 2, the motorized combination vacuum/pressure pump of the present invention has a generally cylindrical plastic housing 12 which is sized to be easily held by a user's hand. At the upper end thereof, a battery pack 18, either holding rechargeable or nonrechargeable batteries, powers an electrical motor 40 having an output shaft 42 which rotates along an axis generally coaxial with housing 12. Alternatively, the motor may be connected by means of a conventional power cord to a source of AC or DC power. Operatively connected to the output shaft 42 of the motor is a piston drive mechanism, which comprises piston drive rotating member 52 and piston drive reciprocating member 50. Piston drive rotating member 52 is connected to output shaft 42 by a pin or other connector. Piston drive reciprocating member 50 is preferably cylindrical in configuration and coaxial with housing 12, and is connected at its lower end to piston 44 which includes a pair of flexible polymeric seals 46 which mate with and slide along the interior walls of chamber 48 within housing 12 in substantially airtight engagement. Both piston 44 and piston drive reciprocating member 50 are preferably integrally formed as a single unit, as shown, and slide in a reciprocating motion, up and down, within the housing as shown by the direction of arrow 51. The upstroke of the piston and piston drive reciprocating member is generally referred to as the vacuum stroke, and the down stroke of piston and piston and piston drive reciprocating member is generally referred to as the pressure stroke.

Figure 3:
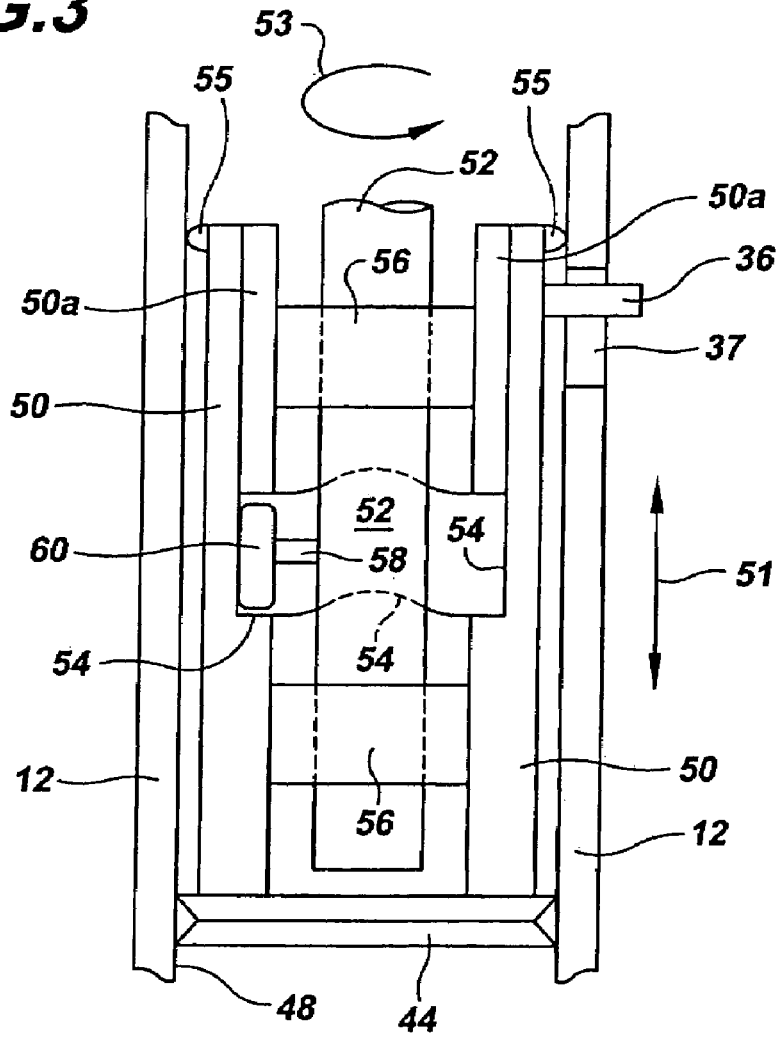
FIG. 3 is a cross-sectional view of the piston and piston drive portion of the preferred vacuum/pressure pump of FIG. 2.
Figure 4:
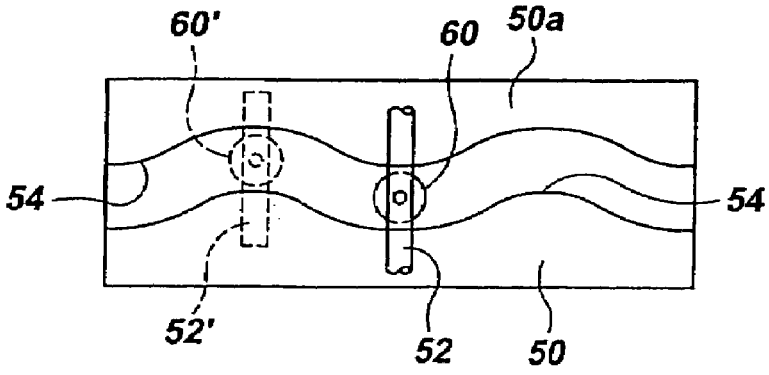
FIG. 4 is a view of the interior of the piston drive chamber of FIG. 3, as it would be if unwrapped.

The structure of the piston drive mechanism is shown in more detail in FIGS. 3 and 4. Piston drive reciprocating member 50 has a hollow cylindrical body, with an outer diameter slightly smaller than the inner diameter of housing 12 to permit it to reciprocate with piston 44 during the vacuum and pressure strokes in the directions of arrow 51. Piston drive rotating member 52 includes a cylindrical shaft portion extending downward from the motor output shaft within reciprocating member 50, and is held in coaxial orientation therewith by bearings 56 mounted within reciprocating member 50 and 50a, to permit relative rotational movement of rotating member 52. Extending around the interior cylindrical wall of reciprocating member 50 is a track 54, which comprises a groove that is non-linear in configuration. In the preferred embodiment, when the interior wall of reciprocating member 50 is shown in an unwrapped view in FIG. 4, track 54 has a sinusoidal configuration which extends upward and downward as it wraps around the inner periphery of reciprocating member 50. The lower portion of track 54 is formed by a sinusoidally extending ledge within member 50, and the upper portion of the track is formed by the lower, complimentarily formed lip of inner sleeve member 50*a*, which is keyed and compression fit or welded to member 50.

Received in sliding and/or rolling relationship within track 54 is a wheel 60, which is mounted on an axle 58 extending transversely from the axis of rotating member 52. When rotating member 52 rotates as shown in direction of arrow 53, it is prevented from reciprocal movement in the direction of arrow 51 by its fixed attachment to output shaft 42 of motor 40. As wheel 60 travels within track 54, due to the non-linear, sinusoidal configuration of the track, a reciprocating movement is imparted to piston drive reciprocating member 50 in direction of arrow 51. A pin 36 extending outward from reciprocating member 50 through a vertical slot 37 in the side of housing 12 prevents reciprocating member 50 from rotational movement in direction 53 while permitting reciprocating movement in directions 51. Spacer ring 55 is connected to and extends around the outer periphery of the upper portion of reciprocating member 50 to permit proper alignment during reciprocating movement. This reciprocating movement is imparted to the operatively connected piston 44 to move piston 44 alternately through vacuum and pressure strokes as motor 40 operates to turn output shaft 42 and rotating member 52. Other non-linear configurations of track 54 may be utilized for example, a saw tooth shape, to impart any type of desired reciprocating movement to piston 44. Instead of the groove shown, the track may be a continuous protrusion extending circumferentially around the inside of reciprocating member 50, and the shaft/wheel slidingly captures the protruding track. Moreover, the position of the track and shaft/wheel may be reversed, so that the track is disposed in the outer side wall of rotational member 52 and the shaft and wheel are disposed extending in from reciprocating member 50. Also, a pair of wheels may be employed, for example, in the embodiment of FIG. 3, wherein an additional axle and wheel extend from member 52 to the right, opposite wheel 60, and also engaged with track 54.

Figure 8:
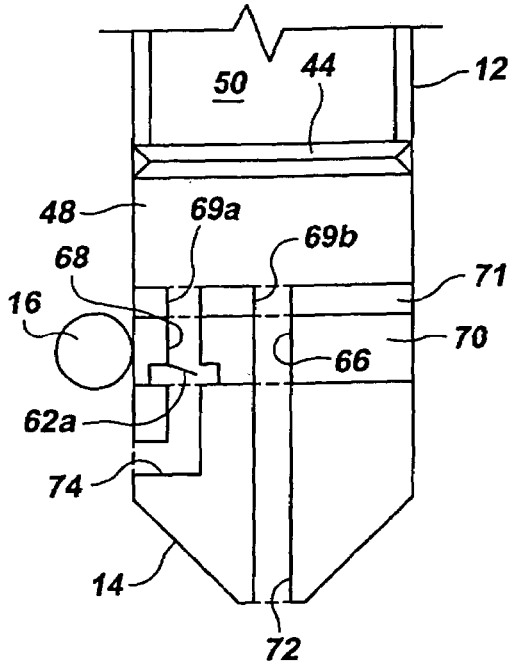
FIG. 8 is a cross-sectional view of the lower portion of the embodiment of FIG. 7, showing the vacuum/pressure switch in the vacuum position.

The pumping motion of piston 44 may be utilized to operate pump 10 in either pressure or vacuum mode. A cylindrical flow control member or switch 70 (see also FIG. 6) extending through housing 12 at the lower end thereof permits the user to select either the pressure or vacuum positions by rotation of valve knob 16. Selectable flow control member 70 is disposed within the walls of a close-fitting, comparably-sized cylindrical opening 76 extending transversely across housing 12. Pump chamber 48 is formed between piston 44, housing 12 walls, and wall 71 above flow control member 70. Openings 69*a*, 69*b* in wall 71 respectively align and permit communication with one-way valves 62*a*, 62*b*, disposed in passageways 66, 68, of member 70. Both passageways extend completely through flow control member 70, so that passageway 66 connects openings 65*a* and 65*b* on opposite sides of member 70, and passageway 68 connects openings 67*a* and 67*b* on opposite sides of member 70 (FIG. 8). The lower opening 67*a* of passageway 68 aligns and communicates with passageway 74 to atmospheric air surrounding housing 12, and the lower opening 65*a* of passageway 66 aligns and communicates with passageway 72 which extends out through a bottom opening of pump head 14, to connect to the food or drink container. Because of its cylindrical configuration, flow control member 70 may be rotated by twisting handle 16 to change the orientations of, and permitted direction of flow through, one-way valves 62*a*, 62*b*. Flow control member 70 preferably has a seal comprising a resilient polymeric surface, or O-rings (not shown) around openings 65*a*, 65*b*, 67*a*, 67*b*, in slidingly sealed airtight relationship with the walls of cylindrical opening 76, to prevent air from passing around or through the member other than through passages 66 and 68, while permitting rotation of the cylindrical member.

Figure 5:
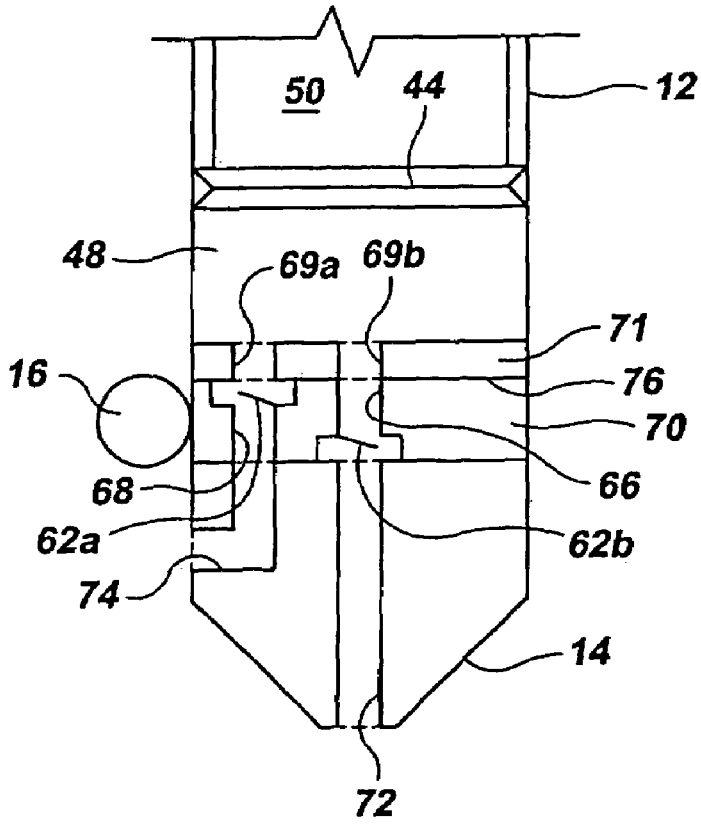
FIG. 5 is a cross-sectional view of the lower portion of the preferred vacuum/pressure pump of FIG. 2, showing the vacuum/pressure switch in the pressure position.

The vacuum and pressure positions of flow control member 70 and the one-way valves therein are shown in FIGS. 2 and 5, respectively. As shown in FIG. 2 in the vacuum-pumping configuration, one-way valve 62*a* is disposed within passageway 68 of flow control member 70, between chamber 48 and slot 74 in the side of pump housing 12 which communicates with atmospheric air surrounding housing 12. One-way valve 62*a* opens to permit only outflow of air from chamber 48, through wall opening 69*a* and passageway 68 to atmosphere during the downward pressure stroke of piston 44. No atmospheric air may pass into chamber 48 through one-way valve 62*a* which closes during the upward vacuum stroke of the piston. Opening 65*a* (FIG. 6) of cylindrical member passage-way 66 communicates with bore 72 which extends out through a bottom opening of pump head 14. During the upstroke of piston 44, air flows through bore 72 in the lower end of housing 12, normally connected to a food or drink container, to one way valve 62*b* which opens to permit only passage of air upward through opening 65*b*, through wall opening 69*b*, and into chamber 48. This permits air to be withdrawn from the container and replenished within chamber 48 during the piston upstroke. One-way valve 62*b* closes and does not permit escape of air from the chamber or through internal passageway 66 to the container during the down stroke of piston 44.

In the pressure-pumping configuration depicted in FIG. 5, knob 16 is rotated 180° to reverse the configurations of the one-way valves in internal passageways 66 and 68. During the upward vacuum stroke of piston 44, air travels inward from atmosphere through slot 74 and through the now lower opening 67*b* of internal passageway 68 in cylindrical member 70, through one-way valve 62*a*, and then upwards and out through opening 67*a* and through opening 69*a* into chamber 48. During the downward pressure stroke of piston 44, one-way valve 62*a* closes and does not permit flow in the reverse direction, i.e., out, of chamber 48. Instead, air in chamber 48 is exhausted through wall opening 69*b* and the now upper opening 65*a* of internal passageway 66, through one-way valve 62*b* and cylindrical member opening 65*b*, and out through bore 72 to the container. One-way valve 62*b* closes and does not permit flow of air in the reverse direction.

The preferred embodiment of pump 10 also incorporates an indicator 110 to signal when the container has reached the proper level of pressure or vacuum. Indicator 110 (FIG. 2) disposed in a chamber 115 comprises a flexible membrane 122 exposed on one side to atmospheric pressure, via a vent opening 113, and on the other side to fluid pressure present in bore 72 and the container interior, via a passageway between chamber 115 and bore 72, as the pump is sealed to the container being pressurized or evacuated. Movable electrical contact 114 is attached to membrane 122, and both move progressively inward (left) when the pressure in bore 72 and the container fall farther below atmospheric pressure, and move progressively outward (right) when the pressure in bore 72 and the container rise above atmospheric pressure. When the bore/container pressure falls to a predetermined degree of vacuum, movable contact 114 completes the circuit between vacuum contact 118 and contact 116, and energizes signal 112 connected to battery pack 18, preferably a light. Conversely, when the bore/container pressure rises to a predetermined degree of overpressure, movable contact 114 completes the circuit between pressure contact 120 and contact 116, and energizes signal light 112. Alternatively, signal 112 may be a sounding device that emits a noise when energized.

Figure 2A:
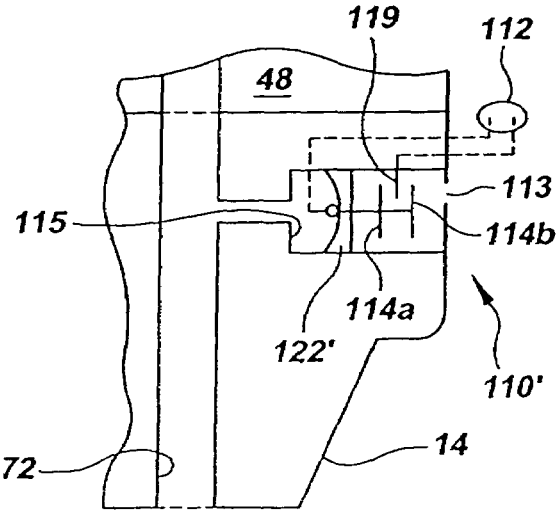
FIG. 2*a* is an enlargement, partially in cross-section and partially in schematic form, of the preferred vacuum/pressure limit indicator employed in the pump of FIG. 2.

Membrane 122 is preferably made from a flexible thermoplastic material of durometer and thickness suitable to move the contacts as described, when exposed to the desired pressure or vacuum limit. As shown in FIG. 2*a*, a preferred embodiment 110' of the indicator, flexible membrane 122' extending across chamber 115 has a curved inner surface to increase the amount of surface area exposed to the pressure differential present in chamber 115, and a pair of movable electrical contacts 114*a*, 114*b* connected thereto. Electrical contact 119 is contacted by movable vacuum contact 114*b* when the bore pressure falls to a predetermined degree of vacuum, and is contacted by movable pressure contact 114*a* when the bore pressure rises to a predetermined degree of overpressure. If either event occurs, the circuit is completed to energize signal 112. The position of contact 119 may be fixed or may be adjustable for calibration purposes.

Figure 6:
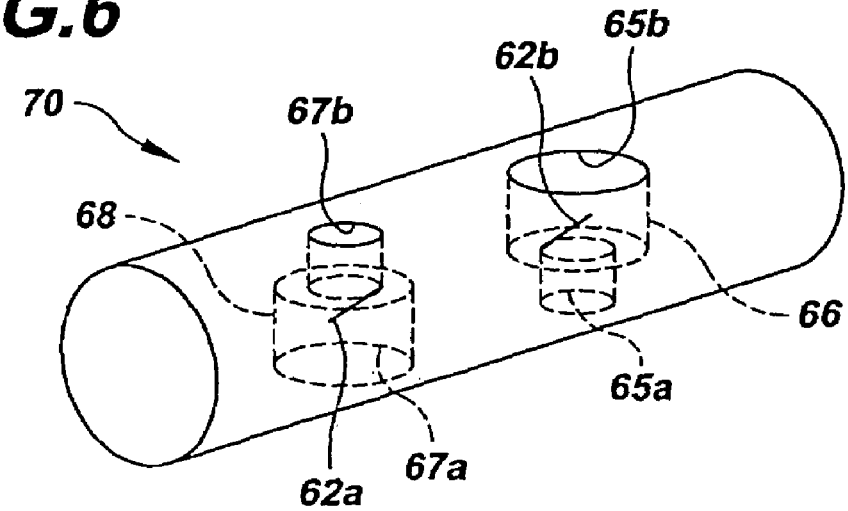
FIG. 6 is a perspective view of the preferred combination vacuum/pressure flow control member or switch utilized in the preferred embodiment of FIGS. 2 and 5.
Figure 7:
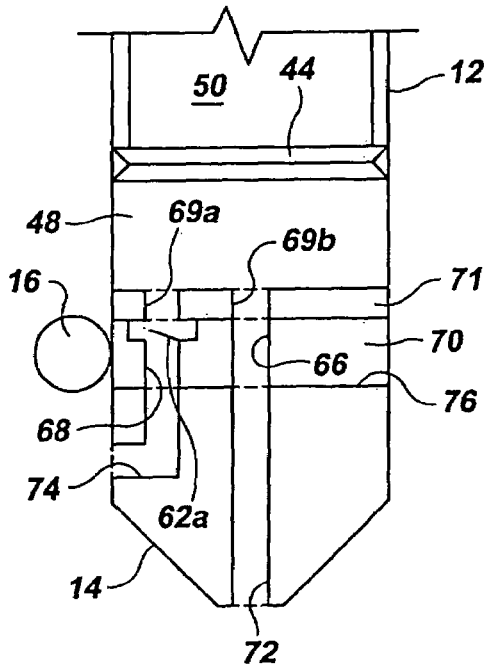
FIG. 7 is a cross-sectional view of the lower portion of another embodiment of vacuum/pressure pump of the present invention, showing the vacuum/pressure switch in the pressure position.

Another embodiment of the combination vacuum/pressure pump of the present invention is depicted in FIGS. 7 and 8, with the flow control member in the pressure and vacuum positions, respectively. This embodiment is the same as shown in FIGS. 2, 5 and 6, except that passageway 66 contains no one-way valve. In the pressure configuration, the pump operates in the same manner as described in connection with FIG. 5, with the exception that during the upstroke of piston 44, there is no one-way valve in flow control member passageway 66 to prevent air flow back into chamber from bore 72. In this embodiment, the pump relies on a one-way valve in the stopper of the food or drink container, such as the vacuum/pressure stopper 20 of U.S. Pat. No. 5,031,785 depicted in FIG. 1, to prevent upflow of air from the container into bore 72. The stopper of FIGS. 12–15, described further below, may also be used with this pump embodiment. Since pump head 14 is coupled and sealed firmly to the opening of the stopper, no air flows into chamber 48 through open passageway 66 during the upstroke.

The vacuum position of flow control valve 70 is shown in FIG. 8, and again the pump operates in a manner similar to that described in FIG. 2, except that there is no one-way valve in passageway 66 to prevent flow of air from chamber 48 and out through bore 72 during the downward stroke of piston 44. In a manner analogous to the pressure configuration, when the pump is coupled to a vacuum stopper 20 of the type shown in FIG. 1, the one-way valve in the stopper prevents air from entering the container, and so no air flows out of chamber 48 through bore 72 in pump head 14.

The combination vacuum/pressure pump embodiments shown in FIGS. 2, 5, 7 and 8 may also be made to be either pressure-only or vacuum-only pumps, by replacing the rotatable flow control member 70 with a fixed member with the one-way valves 62*a* and/or 62*b* in the appropriate orientations. Alternatively, flow control member 70 may be dispensed with entirely, and replaced with fixed passageways 66, 68, and appropriately oriented one-way valves disposed therein.

Figure 9:
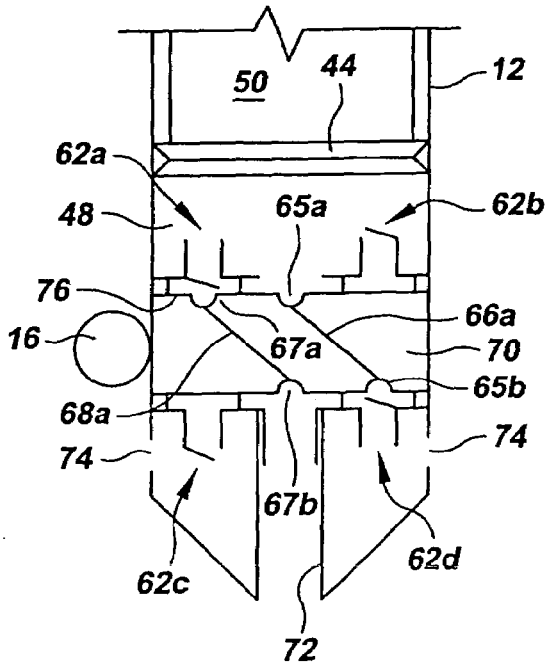
FIG. 9 is a cross-sectional view of the lower portion of another embodiment of the vacuum/pressure pump of the present invention, showing the vacuum/pressure switch in the pressure position.

In another embodiment of the vacuum/pressure pump, depicted in FIGS. 9, 10 and 11, selectable flow control member 70 is disposed below one-way valves 62*a*, 62*b*, and above one-way valves 62*c*, 62*d*, and has only angled passageways 66*a*, 68*a*, without any one-way valves. As shown in FIG. 9 in the pressure-pumping configuration, one-way valve 62*a* is disposed between piston 44 and flow control member 70 within chamber 48, and opens to permit only outflow of air from chamber 48 during the downward pressure stroke of piston 44. No air may pass into chamber 48 through one-way valve 62*a* which closes during the upward vacuum stroke of the piston. One-way valve 62*a* communicates with an internal passageway 68, which extends at an angle from one side of cylindrical member 70 to the other side. During the piston downstroke, air exhausting from chamber 48 through one-way valve 62*a* enters opening 67*a* to internal valve passageway 68, and passes through the passageway 68 to opening 67*b* (see also FIG. 11). Opening 67*b* of cylindrical member 70 communicates with bore 72 which extends out through a bottom opening of pump head 14. During the upstroke of piston 44, atmospheric air flows through a slot 74 in the side of pump housing 12 from atmospheric air surrounding housing 12 to one way valve 62*d* which opens to permit only passage of air upward into opening 65*b* of cylindrical member 70. Another internal passageway 66 extends from opening 65*b* through cylindrical member 70 and out of opening 65*a*, which is in communication with chamber 48. This permits air to be replenished within chamber 48 during the piston upstroke. One-way valve 62*d* closes and does not permit escape of air from the chamber or through internal passageway 66 to the atmosphere during the down stroke of piston 44. Due to the position of flow control member 70 and passageways 66, 68, valves 62*b* and 62*c* do not permit airflow during the pressure-pumping mode. As with the previous embodiment, flow control valve 70 preferably has a polymeric surface or O-rings (not shown) around openings 65*a*, 65*b*, 67*a*, 67*b* to prevent air from passing around or through the member other than through passages 66*a*, 68*a*, while permitting rotation thereof.

Figure 10:
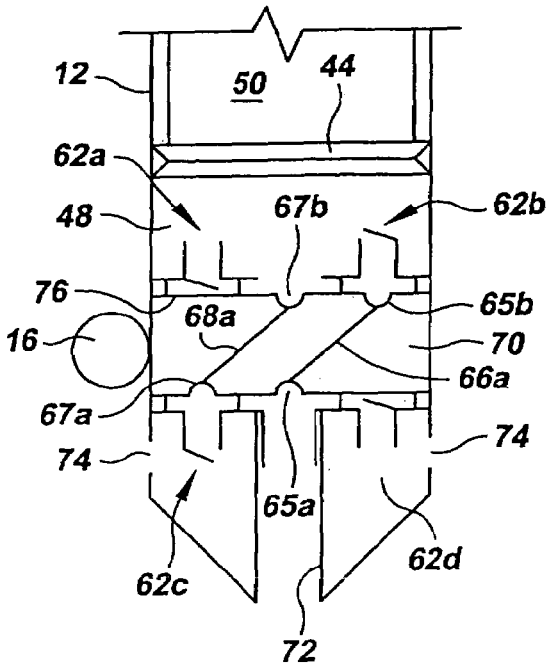
FIG. 10 is a cross-sectional view of the lower portion of the vacuum/pressure pump of FIG. 9, showing the vacuum/pressure valve in the vacuum position.
Figure 11:
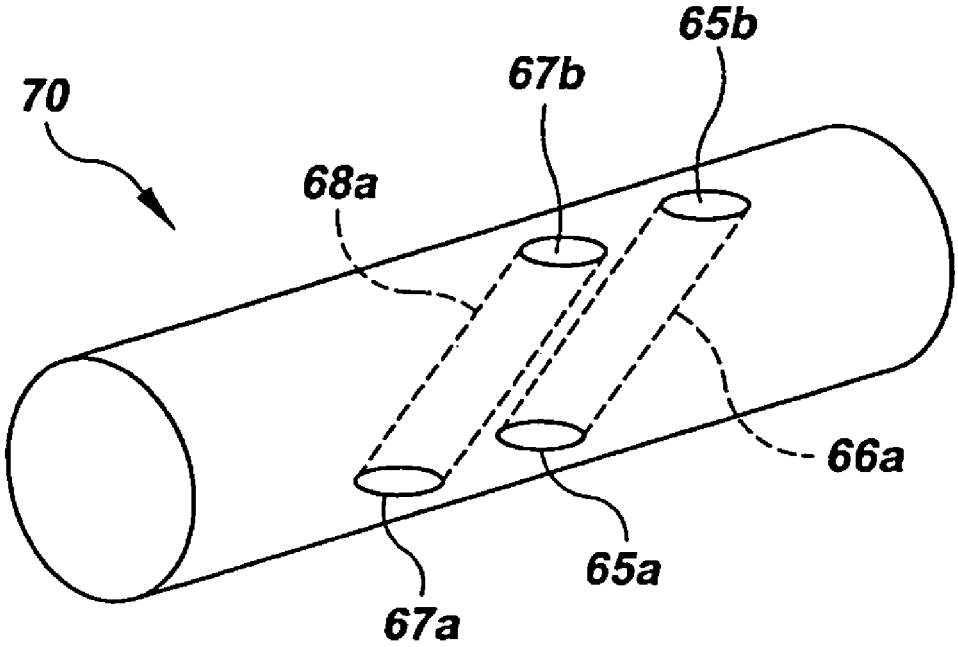
FIG. 11 is a perspective view of the combination vacuum/pressure flow control member or switch utilized in the embodiment of FIGS. 9 and 10.

In the vacuum-pumping configuration depicted in FIG. 10, knob 16 is rotated 180° to reverse the configurations of internal passageways 66 and 68. During the upward vacuum stroke of piston 44, air travels upward through bore 72 and into through the now lower opening 65*a* of internal passageway 66 in cylindrical member 70, and then upwards and out through opening 65*b* and through open one way valve 62*b* into chamber 48. One-way valve 62*b* closes and does not permit flow in the reverse direction, i.e., out, of chamber 48. During the downward pressure stroke of piston 44, air in chamber 48 is exhausted through the now upper opening 67*b* of internal passageway 68 through cylindrical member 70 and opening 67*a*, down through open one way valve 62*c*, and out through another slit 74 to atmosphere. One-way valve 62*c* closes and does not permit flow of air in the reverse direction. Due to the position of flow control member 70 and passageways 66, 68, valves 62*a* and 62*d* do not permit airflow during the vacuum-pumping mode.

Another vacuum/pressure stopper that may be used with the combination vacuum/pressure pump of the present invention is depicted in FIGS. 12–15. Stopper 20*a* has a stopper top 22 for removable sealing engagement with a pump, preferably with pump head 14 engaging lip 24 in upper central opening 99*a*. Stopper bottom 26 is disposed in neck 32 of container 30, and includes a pour passageway formed by upstanding side walls 103, which are spaced inward from lower central opening 99*b* by walls 102, which form parallel annular passageways 101. During pouring, when the container is tipped from an upright position, passageways 101 surrounding pour opening 103 permit air to flow into the container to release back pressure. Pour passageway 103, walls 102 and passageways 101 may be integrally formed with stopper bottom 26, or may be formed as a separate insert. Ball valve body 98 has a generally spherical outer surface mounted within a correspondingly shaped portion of upper central opening 99*a*, with shaft 96 extending outward through an opening in stopper top 22 to external knob 94. Ball valve body 98 is rotatable by knob 94 in direction 105 between pour, pressure seal and vacuum seal positions (as will be explained further below), and seals against the inner walls of upper central opening 99*a* sufficiently to prevent fluid from passing around the ball valve body and shaft, while still permitting rotation. For pressure use, the stopper preferably has a positive clamping mechanism to hold it firmly to the container, for example, the screw top configuration shown in FIG. 5 of U.S. Pat. No. 5,031,785.

Figure 12:
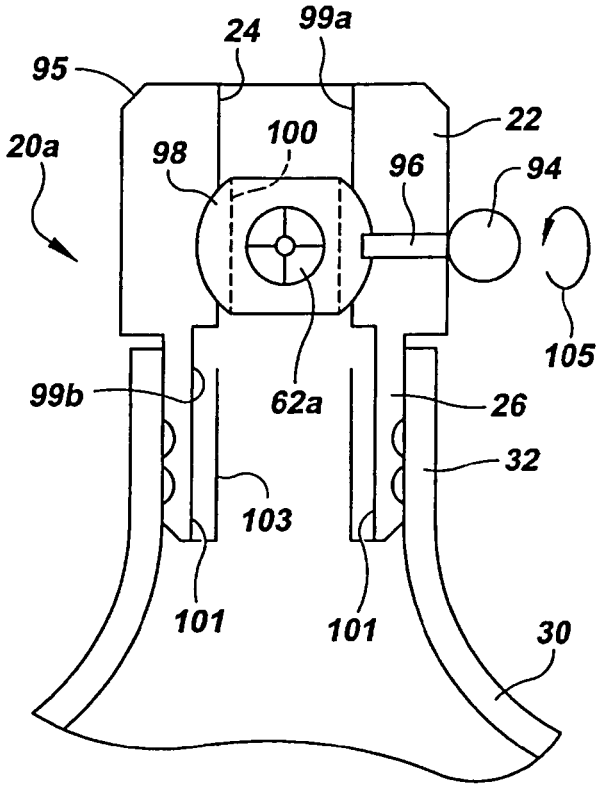
FIG. 12 is a cross-sectional elevational view of a preferred combination vacuum/pressure stopper for a food or drink container, useful with the combination vacuum/pressure pump of the present invention, with the stopper in an open, pour position.
Figure 14:
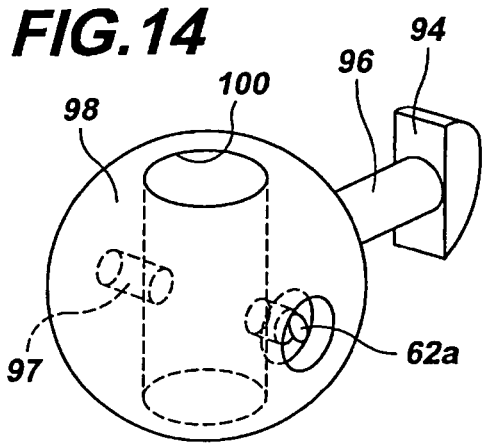
FIG. 14 is a perspective view of the ball valve body and knob employed in the combination vacuum/pressure stopper of FIG. 12.
Figure 13:
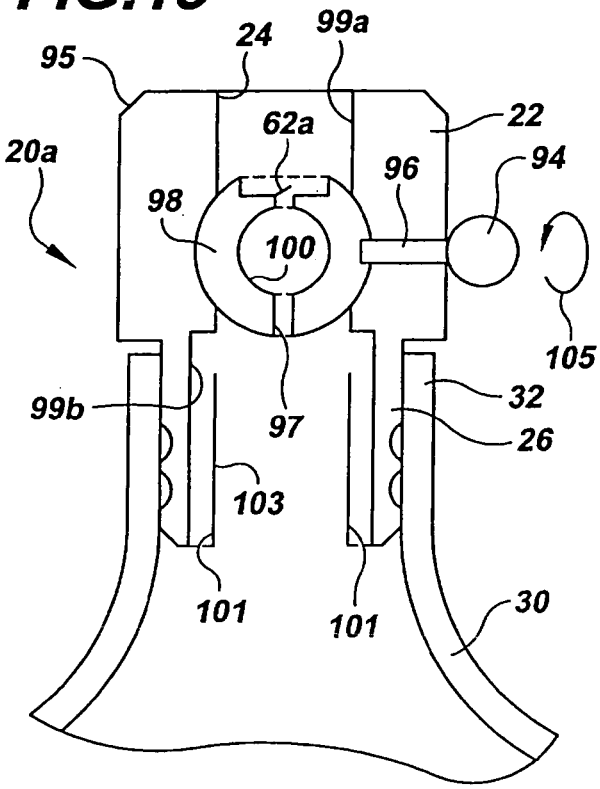
FIG. 13 is a cross-sectional elevational view of the combination vacuum/pressure stopper of FIG. 12, with the stopper in an closed position in which the one-way valve is in an operative vacuum position.
Figure 15:
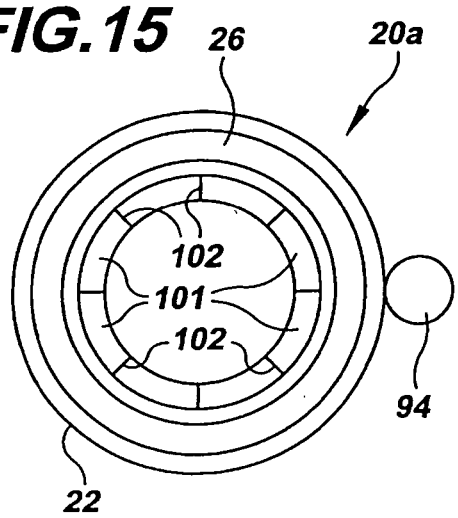
FIG. 15 is a bottom plan view of the combination vacuum/pressure stopper of FIG. 12.

To permit access to the contents of the food or drink container, ball valve body 98 has a pour opening 100 therethrough which, when rotated and aligned with central opening 99*a* to an open position as shown in FIG. 12, permits pouring of fluids into or out of container 30. In the open, pour position, one-way valve 62*a* is inoperative. To seal the container contents for vacuum or pressure, knob 94 is rotated 90° to rotate the orientation of pour opening 100 to a closed position so that it is sealed against the inner walls of opening 99*a*. Disposed along one side of pour opening 100 is an opening containing one-way valve 62*a*, which is opposite passageway 97 on the other side of the pour opening. When knob 94 is rotated 90° in one direction or the other from the pour position, one-way valve 62*a* is placed in either a pressure seal or a vacuum seal operative position within the appropriate stopper. In the vacuum seal position shown in FIG. 13, one-way valve 62*a* seals closed when the contents of container 30 are below outside atmospheric pressure. During vacuum pumping by pump 10, one-way-valve 62*a* opens to permit fluid to be removed from container 30 through passageway 103 and annular opening 101, lower central opening 99*b*, passageway 97 and upper central opening 99*a*. When knob 94 is rotated 1800 from the position of FIG. 13, the orientation of ball valve body 98, one-way valve 62*a* and passageway 97 is inverted and placed in the pressure seal position. In this position (not shown), one-way valve 62*a* seals closed to prevent pressurized fluid from flowing out of container 30, while still permitting fluid to be pumped into the container by pump 10. As described above, for pressure sealing the stopper preferably employs a clamp or seal to keep the stopper in place on the container.

Figure 16:
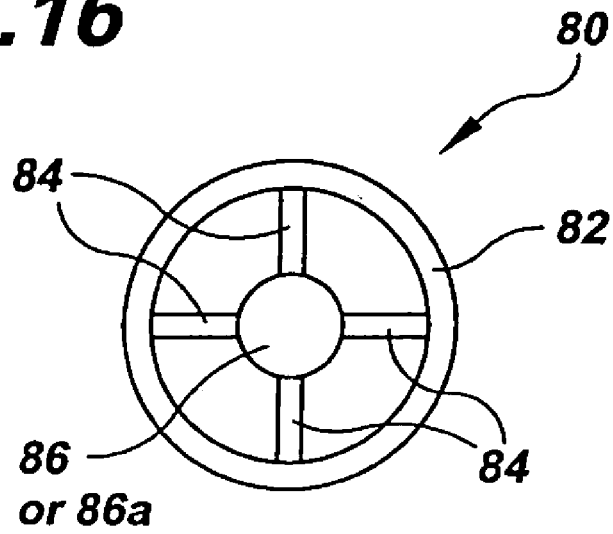
FIG. 16 is a top plan view of the preferred one-way valve diaphragms of the present invention.
Figure 17:
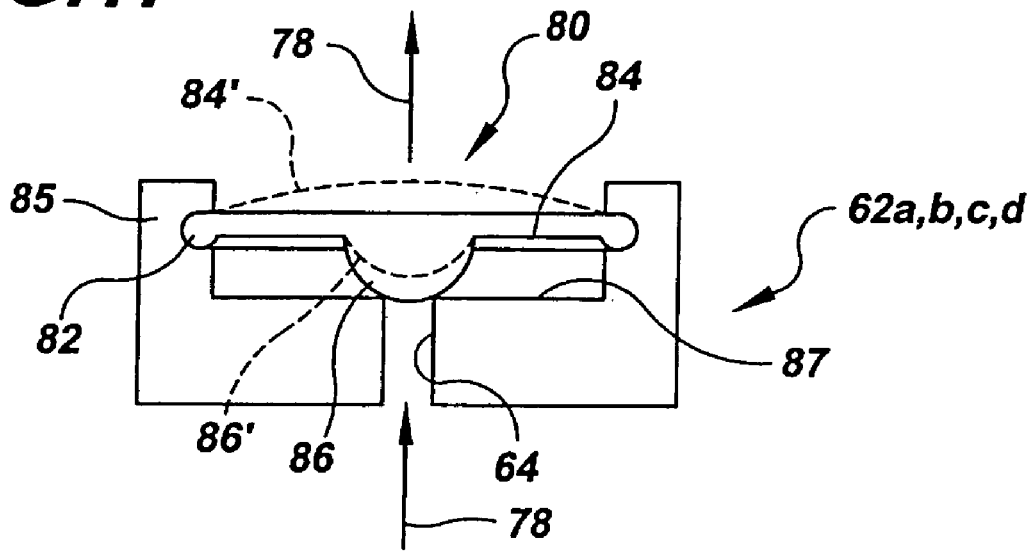
FIG. 17 is a side, cross-sectional, elevational view of the preferred one-way valve of the present invention, employing one embodiment of the diaphragm of FIG. 16.
Figure 18:
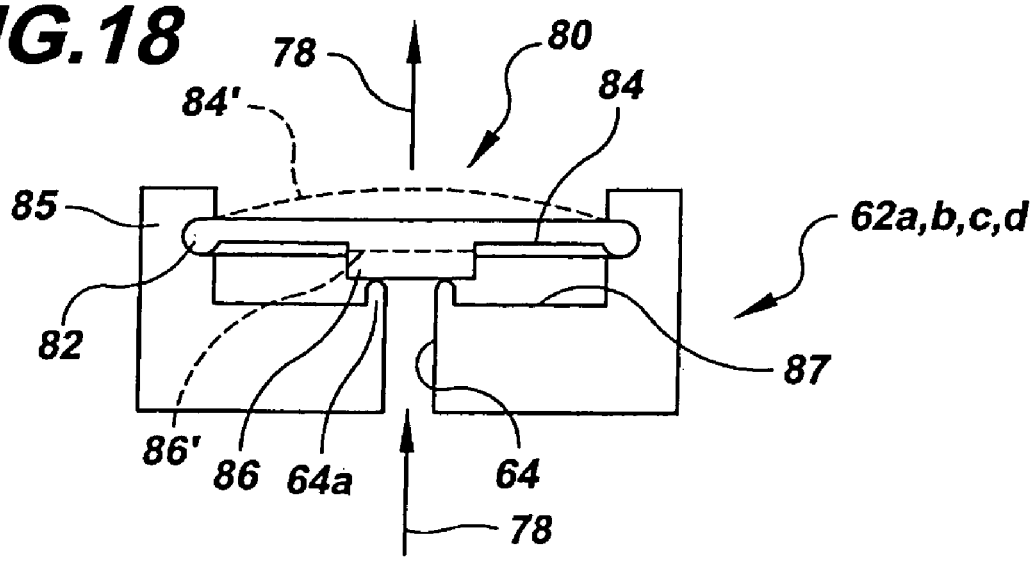
FIG. 18 is a side, cross-sectional, elevational view of the preferred one-way valve of the present invention, employing another embodiment of the diaphragm of FIG. 16.

While any known one-way valves 62*a*, 62*b*, 62*c* and 62*d* may be utilized, for example the flap valve shown in FIGS. 2, 5, 6, 7, 8, 9 and 10, the preferred one-way valve of the present invention is depicted in FIGS. 16, 17 and 18. As shown in FIG. 16, valve diaphragm 80 is made of a one-piece, unitary, flexible polymer and has either a central sealing bulb member 86 (FIG. 17), or a flat cap member 86*a* (FIG. 18), each supported by four arms 84 radially extending inward from ring member 82. FIGS. 17 and 18 depict valve diaphragm 80 mounted in any of one-way valves 62*a*, 62*b*, 62*c* or 62*d* to permit airflow only in direction 78. Because of the different orientations of the one-way valves in the figures, the relative position of the valve depicted in FIG. 17 would be inverted for those one-way valves in which the permitted airflow direction is downward. Valve diaphragm ring member 82 is disposed in the upstanding cylindrical collar 85 of the one-way valve seat 87, outward of one-way valve seat opening 64, so that arms 84 hold bulb 86 (FIG. 17) or cap 86*a* (FIG. 18) in normally biased sealing relationship against valve opening 64 in the base of the valve seat. As shown in FIG. 18, when using cap 86*a*, opening 64 may include an upstanding lip 64*a* to seal against the lower surface of the cap in the closed position. (Lip 64*a* may also be used to seal against the lower surface of bulb 86 in that embodiment.) When air is forced upward through passageway 64 in direction 78, or a vacuum is pulled above diaphragm 80 in direction 78, the bulb is drawn upward into position 86' (FIG. 17), or the cap is drawn upward into position 86*a*' (FIG. 18), and the arms flex and stretch upward into position 84' to open passageway 64 and permit air flow in direction 78. When the airflow is reversed, bulb 86 or cap 86*a* remains seated in opening 64, and does not permit airflow in the direction opposite to arrow 78.

In operation of the combination vacuum/pressure pump of the present invention, the pump head 14 is placed in sealing relationship with a stopper or other opening in a food or drink container. For a vacuum operation, selector knob 16 is rotated to place the cylindrical flow control member 70 in the vacuum position (FIGS. 2, 8, 10) and the motor is turned on. As described previously, the rotational output of motor 40 is translated by the piston drive mechanism to reciprocating motion of piston 44, and given the configuration of one way valves 62*a*, 62*b*, 62*c*, and/or 62*d* and position of the internal passageways 66, 68 of member 70, air is drawn out of the container and exhausted through the pump chamber 48 into the atmosphere until a desired amount of air is withdrawn from the container. At that point the pump is withdrawn and the stopper 20 or 20*a*, or other sealing means prevents the flow of air back into the container.

For pressurizing, pump head 14 is again sealed to a container and knob 16 is rotated to place cylindrical flow control member 70 in the pressure position and invert the positions of passageways 66, 68 (FIGS. 5, 7, 9), whereupon engaging the motor and causing the piston to reciprocate, air is drawn from the atmosphere through chamber 48, member 70 internal passageways and the appropriate one(s) of one-way valves 62*a*, 62*b*, 62*c* and/or 62*d*, and then forced down into the pump container, until it is pressurized to a desired extent. As before, the pump is then removed and the container is sealed by stopper 20 or 20*a*, or other sealing means.

Figure 19:
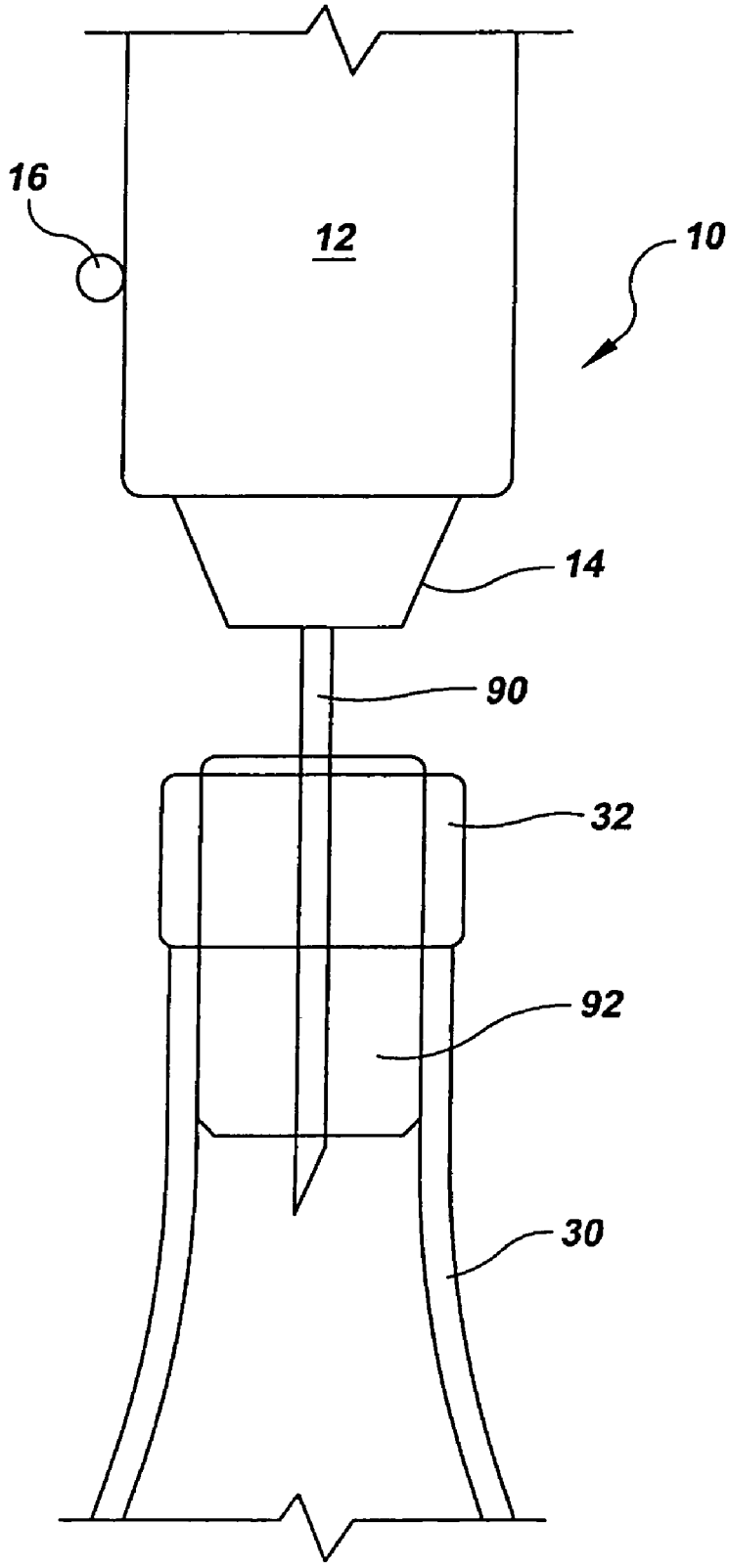
FIG. 19 is an elevational view, partially in cross section, of the combination vacuum/pressure pump of the present invention utilizing a needle to inject pressurized air through the cork and into a wine container.

In addition to evacuating or pressurizing containers through a stopper valve of the type shown in FIGS. 1 or 12–15, the present invention may be utilized to extract a cork from a container, for example a wine bottle, as shown in FIG. 19. An injection needle is sealed to the opening at the bottom of pump head 14 and inserted through cork 92 in the open neck 32 of bottle 30. Pressurized air may be pumped from pump 10 through needle 90 into bottle 30, to force a cork up and out of neck 32.

Figure 20:
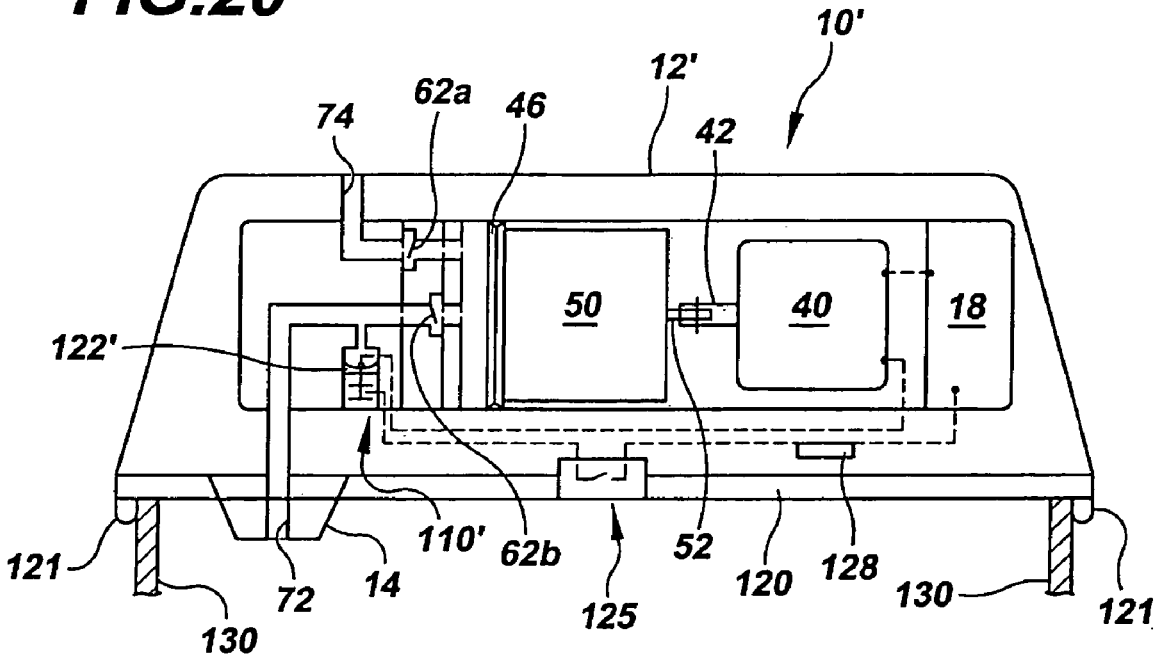
FIG. 20 is an elevational view, partially in cross section, of the pump of the present invention, configured in the vacuum-pumping mode, built into the lid of a food or drink container.
Figure 21:
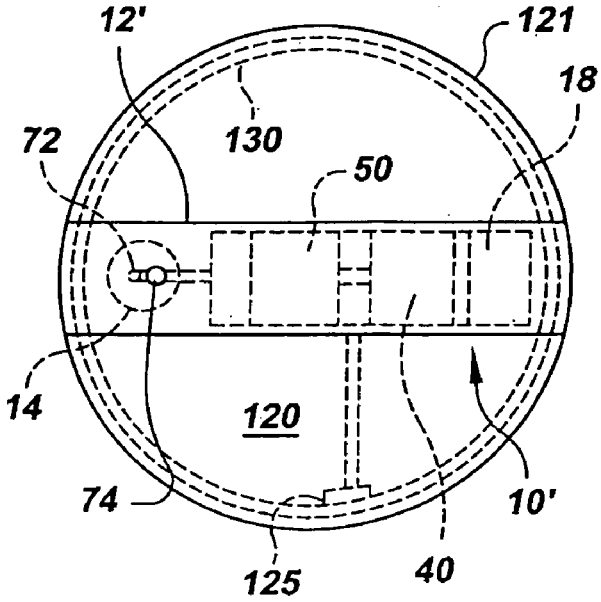
FIG. 21 is a top plan view of the combination vacuum pump and lid of FIG. 20.

In FIGS. 20 and 21 there is depicted the pump of the present invention, configured in the vacuum-pumping mode, in combination with a lid of a food or drink container. Flat, circular lid 120 attaches by a lip 121 at its periphery, by snap fit, to hermetically seal the open neck of a container 130, such as a typical one-pound cylindrical coffee can, or a custom mating container. Pump 10' is shown in a vacuum only mode, without the movable flow control member but otherwise similar to that shown in FIG. 2, and is disposed in a horizontal configuration so that housing 12' serves as a handle to attach and remove the lid. Battery pack 18, motor 40, output shaft 42, rotating member 52, reciprocating member 50, piston seals 46, one-way valves 62*a*, 62*b* and atmospheric vent 74 all operate in the same manner as previously described. Passageway 72 communicates through conical head 14 with the lower side of lid 120 to permit air or other fluid to be pumped out of the interior of container 130. An electrical switch 125 is provided adjacent to the periphery of lid 120, and is movable between a biased open position when the lid is off the container, and a closed position when lid 120 is placed on the container. An electrical circuit is provided connecting battery pack 18, motor 40 and vacuum indicator 110'. Unlike the indicator shown in FIG. 2*a*, the contact moved by membrane 122' is in the normally closed position at atmospheric pressure, and is opened when the pressure in passageway 72 (and the interior of container 130) reaches a desired degree of vacuum, at which time the contacts open. When the lid is snapped onto a container at normal atmospheric pressure, switch 125 is closed and, because the switch contacts of indicator 110' are also closed, the circuit is closed, motor 40 is energized by battery 18, and pump 10' commences removing the air from the interior of container 130. When the predetermined degree of vacuum is achieved, membrane 122' moves to open the contacts of indicator 110', and open the circuit, shutting off the vacuum pump. Since the atmospheric pressure outside the container is higher than the pressure inside the container, one way valves 62*a*, 62*b* are sealed closed, and air cannot enter the container through the lid. Should the seal between lid 120 and container 130 leak while the lid is in place, or if the container otherwise permits air to enter, the contacts of vacuum indicator 110' will again close and return the contents of the container to the predetermined vacuum level. When lid 120 is removed from the container, switch 125 returns to its normally open position, and the pump cannot operate.

If one-way valves 62*a*, 62*b* are reversed, so that the pump operates only in the pressure mode, and indicator 110' is calibrated to open at a predetermined level of pressure above atmospheric, the combination lid 120 and pump 10' may be used to maintain the interior of container 130 in a pressurized state. In their reversed position, one way valves 62*a*, 62*b* are sealed closed because the atmospheric pressure outside the container is lower than the pressure inside the container, and air cannot escape the container through the lid. If air does escape, indicator 110' will close its contacts, and the pump will add more air pressure. Alternatively, in the embodiment of FIGS. 20 and 21, one-way valves 62*a*, 62*b* may be mounted in a movable flow control valve as described previously to provide a switch between vacuum and pressure modes. Lid 120 should be provided with a positive sealing mechanism with container 130, such as a screw or clamp, if used in the pressure mode.

A controller 128, such as a microprocessor, may also be incorporated in the circuit of the lid pump 10' to cycle the pump on and off as desired. This is useful when the container is used for marinating foods. The configuration of truncated conical head 14 permits it to be alternatively used with a stopper as well, as described above, or to directly seal to the opening of a wine bottle. In the latter case, additional structure may be needed to maintain the pump and lid combination on top of the bottle when the bottle is stored.

Thus, the present invention provides a hand-held, motorized combination vacuum/pressure pump, which in one aspect, is conveniently and externally switchable between the vacuum and pressure modes. In another aspect, the pump may be used exclusively in vacuum or pressure modes. In the former, the pump may also be combined with a container lid to automatically maintain a vacuum when in place; in the latter the pump may also be used with a needle to remove corks from wine bottles. The stopper of the present invention is conveniently switchable between pour and either vacuum- or pressure-keeping modes for the container. The pump and stopper of the present invention may be used in combination with each other, as described herein, or with other stoppers and pumps, respectively.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A combination vacuum and pressure pump comprising:

a pump housing having an opening for connection to a container to be evacuated or pressurized;

a pump chamber within the pump housing;

a piston in sliding, substantially airtight engagement with walls of the pump chamber, adapted to reciprocate between pressure and vacuum strokes within the chamber;

a rotary drive in the pump housing powering a rotatable output shaft;

a piston drive operatively connecting the motor output shaft and the piston adapted to convert rotational movement of the output shaft to reciprocating motion of the piston within the pump chamber;

at least one one-way valve, communicating with the pump chamber, permitting passage of fluid only into or out of the pump chamber;

a selectable flow control member in the pump housing having a pair of passages therein and movable between pressure and vacuum positions;

in the pressure position one of the selectable flow control member passages connecting the pump chamber and the pump housing opening to permit passage of fluid from the pump chamber out of the housing connection opening during the piston pressure stroke, and the other of the selectable flow control member passages permitting passage of fluid into the pump chamber from a region external to the pump chamber through a one-way valve during the piston vacuum stroke; and in the vacuum position one of the first selectable flow control member passages connecting a one-way valve to the pump chamber to permit passage of fluid from the pump chamber out to the external region through the one-way valve during the piston pressure stroke, and the other of the selectable flow control member passages permitting passage of fluid from the housing connection opening to the pump chamber during the piston vacuum stroke.

2. The pump of claim 1 wherein the selectable flow control member has a first passage extending from one side to the other, and the one-way valve is disposed in the selectable flow control member first passage, the selectable flow control member being rotatable: i) in the pressure position, to place the one-way valve in an orientation to permit passage of fluid only into the piston chamber, and ii) in the vacuum position, to place the one-way valve in an orientation to permit passage of fluid only out of the piston chamber.

3. The pump of claim 1 wherein the selectable flow control member has a pair of passages extending from one side to the other, and including a first one-way valve disposed in one of the selectable flow control member passages and a second one-way valve disposed in the other of the selectable flow control member passages, the one way valves being disposed in opposite orientations in the passages, the selectable flow control member being rotatable: i) in the pressure position, to place the first one-way valve in an orientation to permit passage of fluid from the external region only into the piston chamber and to place the second one-way valve in an orientation to permit passage of fluid only out from the piston chamber and through the housing connection opening, and ii) in the vacuum position, to place the first one-way valve in an orientation to permit passage of fluid from the piston chamber only out to the external region and to place the second one-way valve in an orientation to permit passage of fluid only into the piston chamber from the housing connection opening.

4. The pump of claim 1 including:

a pair of one-way valves communicating with the pump chamber, the first one-way chamber valve permitting passage of fluid only into the pump chamber, and the second one-way chamber valve permitting passage of fluid only out of the pump chamber;

a pair of one-way valves communicating externally to the pump housing, the first one-way external valve permitting passage of fluid only out to a region external to the pump housing, and the second one-way external valve permitting passage of fluid only out of the housing connection opening;

and wherein the selectable flow control member is disposed in the pump housing between the one-way chamber valves and the one-way external valves, the selectable flow control member having a pair of passages therein and movable between pressure and vacuum positions, in the pressure position the first selectable flow control member passage connecting the second one-way chamber valve to the housing connection opening and the second selectable flow control member passage connecting the pump chamber to the second one-way external valve, thereby permitting passage of fluid from the pump chamber out of the housing connection opening during the piston pressure stroke, and permitting passage of fluid from the external region to the pump chamber during the piston vacuum stroke, and in the vacuum position the first selectable flow control member passage connecting the pump chamber to the first external valve opening and the second selectable flow control member passage connecting the first chamber valve to the housing connection opening, thereby permitting passage of fluid from the pump chamber out to the external region during the piston pressure stroke, and permitting passage of fluid from the housing connection opening to the pump chamber during the piston vacuum stroke.

5. The pump of claim 1 wherein the piston drive comprises a member extending transversely to the direction of movement of the piston and a track extending circumferentially around and engaging the transversely extending member in sliding relationship, the track having a non-linear configuration such that, upon rotation of the output shaft, the transversely extending member slides with respect to the track and imparts a reciprocating motion to the operatively connected piston within the pump chamber.

6. The pump of claim 1 wherein the selectable flow control member comprises a body rotatingly received within a cavity in the pump housing, and wherein the passage therein extends from one side surface of the body to the other side surface of the body.

7. The pump of claim 1 wherein the selectable flow control member comprises a cylindrical body rotatingly received within a cavity in the pump housing, and wherein the passage therein extends from an opening on one side surface of the body to an opening on the other side surface of the body, and further including a seal extending around the flow control member body, between the body and the cavity, separating the passage openings on each side surface of the flow control member body.

8. The pump of claim 1 wherein the selectable flow control member is rotatingly received within a cavity in the pump housing, and further including a handle extending outward of the pump housing for rotating the selectable flow control member between the pressure and vacuum positions.

9. The pump of claim 1 wherein the rotary drive comprises an electric motor.

10. The pump of claim 5 wherein the track has a substantially sinusoidal configuration.

11. The pump of claim 5 wherein the transversely extending member comprises at least one wheel slidingly received in the track.

12. The pump of claim 5 wherein the transversely extending member comprises at least one wheel slidingly captured in the track, the track having a substantially sinusoidal configuration.

13. The pump of claim 5 wherein the track extends circumferentially around an interior wall of a reciprocating drive member connected to the piston.

14. The pump of claim 5 wherein the transversely extending member is disposed on a rotatable drive member operatively connected to the motor output shaft.

15. The pump of claim 5 wherein the track extends circumferentially around an interior wall of a reciprocating drive member operatively connected to the piston and the transversely extending member is disposed on a rotatable drive member operatively connected to the motor output shaft, the rotatable drive member extending within the reciprocating drive member and adapted to rotate the transversely extending member to cause the transversely extending member to slide within the track and impart reciprocating motion to the operatively connected piston within the pump chamber.

16. The pump of claim 1 wherein the one-way valve comprises a valve seat having an opening therein; and a valve diaphragm having a sealing member supported by flexible arms in a normally biased position against and sealing the valve seat opening, wherein when a fluid is forced in a first direction through the valve seat opening against the sealing member, the arms flex and move the sealing member away from the valve seat opening to permit fluid flow out of the valve seat opening, and when the fluid is forced in a direction opposite the first direction, the arms do not flex and the sealing member remains in the normally biased position against and sealing the valve seat opening to restrict fluid flow.

17. The pump of claim 16 wherein the sealing member comprises a bulb or cap suspended by a plurality of radially extending arms attached to the valve seat outward of the valve seat opening.

18. A combination vacuum and pressure pump comprising:

a pump housing having an opening for connection to a container to be evacuated or pressurized;

a pump chamber within the pump housing;

a piston in sliding, substantially airtight engagement with walls of the pump chamber, adapted to reciprocate between pressure and vacuum strokes within the chamber;

at least one one-way valve communicating with the pump chamber, permitting passage of fluid only into or out of the pump chamber;

a selectable flow control member in the pump housing having a pair of passages therein and movable between pressure and vacuum positions;

in the pressure position one of the selectable flow control member passages connecting the pump chamber and the pump housing opening to permit passage of fluid from the pump chamber out of the housing connection opening during the piston pressure stroke, and the other of the selectable flow control member passages permitting passage of fluid into the pump chamber from a region external to the pump chamber through a one-way valve during the piston vacuum stroke; and in the vacuum position one of the first selectable flow control member passages connecting a one-way valve to the pump chamber to permit passage of fluid from the pump chamber out to the external region through the one-way valve during the piston pressure stroke, and the other of the selectable flow control member passages permitting passage of fluid from the housing connection opening to the pump chamber during the piston vacuum stroke.

19. The pump of claim 18 wherein the selectable flow control member has a first passage extending from one side to the other, and the one-way valve is disposed in the selectable flow control member first passage, the selectable flow control member being rotatable: i) in the pressure position, to place the one-way valve in an orientation to permit passage of fluid only into the piston chamber, and ii) in the vacuum position, to place the one-way valve in an orientation to permit passage of fluid only out of the piston chamber.

20. The pump of claim 18 wherein the selectable flow control member has a pair of passages extending from one side to the other, and including a first one-way valve disposed in one of the selectable flow control member passages and a second one-way valve disposed in the other of the selectable flow control member passages the one way valves being disposed in opposite positions in the passages, the selectable flow control member being rotatable: i) in the pressure position, to place the first one-way valve in an orientation to permit passage of fluid from the external region only into the piston chamber and to place the second one-way valve in an orientation to permit passage of fluid only out from the piston chamber and through the housing connection opening, and ii) in the vacuum position, to place the first one-way valve in an orientation to permit passage of fluid from the piston chamber only out to the external region and to place the second one-way valve in an orientation to permit passage of fluid only into the piston chamber from the housing connection opening.

21. The pump of claim 18 including:

a pair of one-way valves communicating with the pump chamber, the first one-way chamber valve permitting passage of air only into the pump chamber, and the second one-way chamber valve permitting passage of air only out of the pump chamber;

a pair of one-way valves communicating externally to the pump housing, the first one-way external valve permitting passage of air only out to atmosphere surrounding the pump housing, and the second one-way external valve permitting passage of air only out of the housing connection opening;

and wherein the selectable flow control member is disposed in the pump housing between the one-way chamber valves and the one-way external valves, the selectable flow control member having a pair of passages therein and movable between pressure and vacuum positions, in the pressure position the first selectable member passage connecting the second one-way chamber valve to the housing connection opening and the second selectable member passage connecting the pump chamber to the second one-way external valve, thereby permitting passage of air from the pump chamber out of the housing connection opening during the piston pressure stroke, and permitting passage of air from the atmosphere to the pump chamber during the piston vacuum stroke, and in the vacuum position the first selectable member passage connecting the pump chamber to the first external valve opening and the second selectable member passage connecting the first chamber valve to the housing connection opening, thereby permitting passage of air from the pump chamber out to the atmosphere during the piston pressure stroke, and permitting passage of air from the housing connection opening to the pump chamber during the piston vacuum stroke.

22. The pump of claim 18 wherein the selectable flow control member comprises a body rotatingly received within a cavity in the pump housing, and wherein the passages therein extend from one side surface of the body to the other side surface of the body.

23. The pump of claim 18 wherein the selectable flow control member comprises a cylindrical body rotatingly received within a cylindrical cavity in the pump housing.

24. The pump of claim 18 wherein the selectable flow control member comprises a body rotatingly received within a cavity in the pump housing, and wherein the passages therein extend from an opening on one side surface of the body to an opening on the other side surface of the body, and further including a seal extending around the body, between the body and valve cavity, separating the passage openings on each side surface of the body.

25. The pump of claim 18 wherein the selectable flow control member is rotatingly received within a cavity in the pump housing, and further including a handle extending outward of the pump housing for rotating the selectable flow control member between the pressure and vacuum positions.

26. The pump of claim 18 wherein the one-way valve comprises a valve seat having an opening therein; and a valve diaphragm having a sealing member supported by flexible arms in a normally biased position against and sealing the valve seat opening, wherein when a fluid is forced in a first direction through the valve seat opening against the sealing member, the arms flex and move the sealing member away from the valve seat opening to permit fluid flow out of the valve seat opening, and when the fluid is forced in a direction opposite the first direction, the arms do not flex and the sealing member remains in the normally biased position against and sealing the valve seat opening to restrict fluid flow.

27. The pump of claim 26 wherein the sealing member comprises a bulb or cap suspended by a plurality of radially extending arms attached to the valve seat outward of the valve seat opening.

28. The pump of claim 18 further including a motor for reciprocating the piston within the pump chamber.

29. The pump of claim 18 further including a motor having a rotating output shaft and a piston drive for converting rotary movement of the output shaft to reciprocating motion of the piston within the pump chamber.

30. The pump of claim 18 further including a motor having a rotating output shaft and a piston drive for converting rotary movement of the output shaft to reciprocating motion of the piston within the pump chamber, the piston drive comprising a member extending transversely to the direction of movement of the piston and a track extending circumferentially around and engaging the transversely extending member in sliding relationship, the track having a non-linear configuration such that, upon rotation of the output shaft, the transversely extending member slides with respect to the track and imparts a reciprocating motion to the piston within the pump chamber.

31. The pump of claim 18, wherein the pump housing opening is removably connected to an opening of a food or drink container.

32. The pump of claim 18, wherein the pump housing opening is removably connected to a one-way stopper in an opening of a food or drink container.

33. A pump and stopper combination comprising:

a stopper for contacting and sealing with an opening in a container, the stopper having a pour opening for accessing contents in the container, the pour opening being movable between open and closed positions, and a one way valve movably disposed in the stopper between an operative position to permit one-way flow of fluid into or out of the container when the pour opening is in the closed position, and an inoperative position when the pour opening is in the open position, the one-way stop per valve comprising a valve seat having an opening therein; and a valve diaphragm having a sealing member supported by flexible arms in a normally biased position against and sealing the valve seat opening, wherein when a fluid is forced in a first direction through the valve seat opening against the sealing member, the arms flex and move the sealing member away from the valve seat opening to permit fluid flow out of the valve seat opening, and when the fluid is forced in a direction opposite the first direction, the arms do not flex and the sealing member remains in the normally biased position against and sealing the valve seat opening to restrict fluid flow; and a vacuum/pressure pump comprising a pump housing having an opening for connection to said stopper; a pump chamber within the pump housing; a piston in sliding, substantially airtight engagement with walls of the pump chamber, adapted to reciprocate between pressure and vacuum strokes within the chamber; a rotary drive in the pump housing powering a rotatable out put shaft; a piston drive operatively connecting the motor output shaft and the piston adapted to convert rotational movement of the output shaft to reciprocating motion of the piston within the pump chamber; at least one one-way pump valve, communicating with the pump chamber, permitting passage of fluid only into or out of the pump chamber; a selectable flow control member in the pump housing having a pair of passages therein and movable between pressure and vacuum positions; in the pressure position one of the selectable flow control member passages connecting the pump chamber and the pump housing opening to permit passage of fluid from the pump chamber out of the housing connection opening during the piston pressure stroke, and the other of the selectable flow control member passages permit ting passage of fluid into the pump chamber from a region external to the pump chamber through a one-way pump valve during the piston vacuum stroke; and in the vacuum position one of the first selectable flow control member passages connecting a one-way pump valve to the pump chamber to permit passage of fluid from the pump chamber out to the external region through the one-way valve during the piston pressure stroke, and the other of the selectable flow control member passages permitting passage of fluid from the housing connection opening to the pump chamber during the piston vacuum stroke; and an indicator for indicating when a desired level of vacuum or pressure has been reached comprising a flexible membrane exposed to atmospheric pressure outside the pump and to fluid pressure present within the pump chamber, a movable electrical contact operatively connected to the membrane to complete one circuit when the pressure in the pump falls to a desired pressure below atmospheric pressure, and complete an other circuit when the pressure in the pump rises to a desired pressure above atmospheric pressure, and an indicator signal energizable when the movable electrical contact completes either one or the other circuit.

* * * * *